United States Patent [19]

Jensen

[11] 4,330,704

[45] May 18, 1982

[54] ELECTRICAL DEVICES COMPRISING CONDUCTIVE POLYMERS

[75] Inventor: Michael L. Jensen, Mountain View, Calif.

[73] Assignee: Raychem Corporation, Menlo Park, Calif.

[21] Appl. No.: 176,300

[22] Filed: Aug. 8, 1980

[51] Int. Cl.[3] ..... H05B 3/10

[52] U.S. Cl. ..... 219/553; 174/110 PM; 219/505; 219/528; 219/541; 219/543; 252/511; 264/105; 338/22 R; 338/328

[58] Field of Search ..... 219/504, 505, 528, 541, 219/543, 548, 549, 552, 553; 338/22 R, 22 SD, 38, 316, 211, 212, 223, 322, 331, 328, 330; 13/25; 252/511; 174/92, 94 R, 110 PM, 138 F, DIG. 8

[56] References Cited

U.S. PATENT DOCUMENTS

| | | | |
|---|---|---|---|
| 3,105,136 | 9/1963 | Ashenfare | 219/543 X |
| 3,243,753 | 3/1966 | Kohler | 338/31 |
| 3,311,862 | 3/1967 | Rees | 338/211 |
| 3,344,385 | 9/1967 | Bartos | 338/212 |
| 3,345,448 | 10/1967 | Malkin | 13/25 |
| 3,351,882 | 11/1967 | Kohler et al. | 338/322 |
| 3,956,614 | 5/1976 | Hervert | 219/541 |
| 3,995,143 | 11/1976 | Hervert | 219/543 X |
| 4,017,715 | 4/1977 | Whitney et al. | 219/553 |
| 4,085,286 | 4/1978 | Horsma et al. | 174/92 |
| 4,095,044 | 6/1978 | Horsma et al. | 174/138 F |
| 4,164,646 | 8/1979 | Grise | 219/541 |
| 4,177,376 | 12/1979 | Horsma et al. | 219/553 |
| 4,177,446 | 12/1979 | Diaz | 338/212 |
| 4,237,441 | 12/1980 | van Konynenburg et al. | 338/22 R |
| 4,238,812 | 12/1980 | Middleman et al. | 361/106 |
| 4,246,468 | 1/1981 | Horsma et al. | 219/553 |
| 4,255,698 | 3/1981 | Simon | 320/35 |
| 4,272,471 | 6/1981 | Walker | 264/104 |

OTHER PUBLICATIONS

Metalloplastics, A Concept for Conductivity, by Donald E. Davenport.

*Primary Examiner*—Volodymyr Y. Mayewsky
*Attorney, Agent, or Firm*—Lyon & Lyon

[57] ABSTRACT

An improved means of making an electrical connection to a laminar electrode which is in contact with a conductive polymer element. A mat of conductive filaments is placed between the electrode and an apertured conductive member to which the electrical connection is made, and the electrode, the mat and the conductive member are bonded together by means of a polymer or other bonding agent. The presence of the mat between the electrode and conductive member reduces the danger of fracturing the electrode when the conductive member is bonded thereto by heat and pressure. The invention is particularly useful when an ultrasonic welding machine is used to press the conductive member through a layer of polymer to make contact with an electrode underneath the layer.

27 Claims, 3 Drawing Figures

ELECTRICAL DEVICES COMPRISING CONDUCTIVE POLYMERS

BACKGROUND OF THE INVENTION

1. Field of the Invention

This invention relates to electrical devices comprising conductive polymers, and in particular to an improved means for making an electrical connection to a laminar electrode in such a device.

2. Summary of the Prior Art

Conductive polymer compositions [including such compositions which exhibit positive temperature coefficient (PTC), zero temperature coefficient (ZTC) or negative temperature coefficient (NTC) behavior] and electrical devices comprising them, are known. Reference may be made for example to U.S. Pat. Nos. 2,978,665 (Vernet et al.), 3,243,753 (Kohler), 3,311,862 (Rees), 3,351,882 (Kohler et al.), 4,017,715 (Whitney et al.), 4,085,286 (Horsma et al.), 4,095,044 (Horsma et al.), 4,177,376 (Horsma et al.) and 4,177,446 (Diaz) and to copending and commonly assigned applications Ser. Nos. 818,711 (Horsma et al.), 963,372 (Horsma), 965,343 (Van Konynenburg et al.), now U.S. Pat. No. 4,237,441, 965,344 (Middleman et al.), now U.S. Pat. No. 4,238,812, 969,928 (Van Konynenburg et al.), 6,773 (Simon), now U.S. Pat. No. 4,255,698, 38,218 (Middleman et al.), 41,107 (Walker), now U.S. Pat. No. 4,272,471, and the continuation-in-part thereof filed July 10, 1980, Ser. No. 167,364, 75,413 (Van Konynenburg), 84,352 (Horsma et al.), 85,679 (Toy et al.), 88,344 (Lutz) now abandoned, 98,711 (Middleman et al.), 98,712 (Middleman et al.), 102,576 (Brigham), the application filed by Brigham on Dec. 7, 1979, Ser. No. 102,621, now abandoned, 134,354 (Lutz), 141,984 (Gotcher et al.), 141,987 (Middleman et al.), 141,988 (Fouts et al.), 141,989 (Evans), 141,990 (Walty), 141,991 (Fouts et al.), 142,053 (Middleman et al.), 142,054 (Middleman et al.) and the application filed by Cardinal et al. on July 31, 1980, Ser. No. 174,136. The disclosure of each of these patents and patent applications is incorporated herein by reference. The term "conductive polymer" composition is used herein to denote a composition which has a resistivity of less than $10^6$ ohm·cm at a temperature between 0° C. and 200° C., preferably at 25° C.

In many such devices, current is passed through the conductive polymer by means of laminar electrodes, and the electrical leads to the remainder of the circuit are attached to the electrodes. The electrodes are generally composed of a material having a resistivity of at most $5\times10^{-2}$ ohm·cm, preferably a metal. The thickness of the electrodes may be such that there is a substantial potential drop from one end of the electrode to the other or it may be such that all points on any particular electrode are at substantially the same potential. When the device comprises a heat-recoverable member, the electrodes must deform easily when the member is heat-recovered and, if applied before the member is rendered heat-recoverable, in the process in which it is rendered heat-recoverable. When the devices are subject to temperature cycling, differences between the thermal coefficients of expansion of the electrode materials and the conductive polymers tend to result in separation of the electrode from the conductive polymer element. This is of course highly undesirable. The problem is particularly severe when the conductive polymer element comprises a PTC or NTC conductive polymer element, since the PTC or NTC effect depends upon a change in the volume of the PTC or NTC element. It is, therefore, preferred to use an electrode which can accommodate the amount of movement which is to be expected in preparation and/or use of the device, especially an electrode having a plurality of apertures therein e.g. a metal mesh or grid, the apertures of the electrode preferably being of a size such that the conductive polymer can penetrate into the apertures and anchor the electrode and the conductive polymer to each other. Unfortunately, however, there are serious problems in securing electrical leads to these preferred electrodes.

SUMMARY OF THE INVENTION

I have now discovered an improved means for making an electrical connection to a laminar electrode which contacts a conductive polymer element.

In one aspect, the invention provides an electrical device which comprises a conductive polymer element and a laminar electrode in physical contact with the conductive polymer element, said electrode having secured thereto an electrical connection means comprising (1) a laminar, self-supporting conductive member having apertures therein;

(2) a filamentous member which comprises a plurality of conductive filaments, at least some of the conductive filaments physically contacting the electrode and being deformed from their natural configuration to conform at least partially with the surface of the electrode, at least some of the conductive filaments physically contacting the laminar conductive member and being deformed from their natural configuration to conform at least partially with the surface of the laminar conductive member, and at least some of the conductive filaments lying between and electrically connecting the electrode and the laminar conductive member; and (3) a bonding material which bonds to each other the electrode, the laminar conductive member and at least some of the conductive filaments.

In another aspect, the invention provides a method of providing an electrical connection means on a laminar electrode which is in physical contact with a conductive polymer element, which method comprises (1) placing over the laminar electrode a filamentous member comprising a plurality of conductive filaments, the filamentous member being compressible by deformation of said conductive filaments in step (4) of the method;

(2) placing over the filamentous member a laminar self-supporting conductive member having a plurality of apertures therein;

(3) providing, on top of the self-supporting conductive member or between the laminar electrode and the self-supporting conductive member a bonding material which will bond the electrode, the filamentous member and the conductive member to each other after step (5) of the method;

(4) heating the filamentous member, the conductive member and the bonding material, while pressing the conductive member towards the electrode, whereby the filamentous member is compressed and the bonding material flows between and aroun the conductive filaments and into contact with the electrode and the conductive member; and (5) cooling the filamentous member, the conductive member and the bonding material, preferably while maintaining pressure.

An ultrasonic welding machine is preferably used to produce the heat and pressure required in step (4).

BRIEF DESCRIPTION OF THE DRAWINGS

The invention is illustrated in the accompanying drawings, in which.

DETAILED DESCRIPTION OF THE INVENTION

Figure 1:
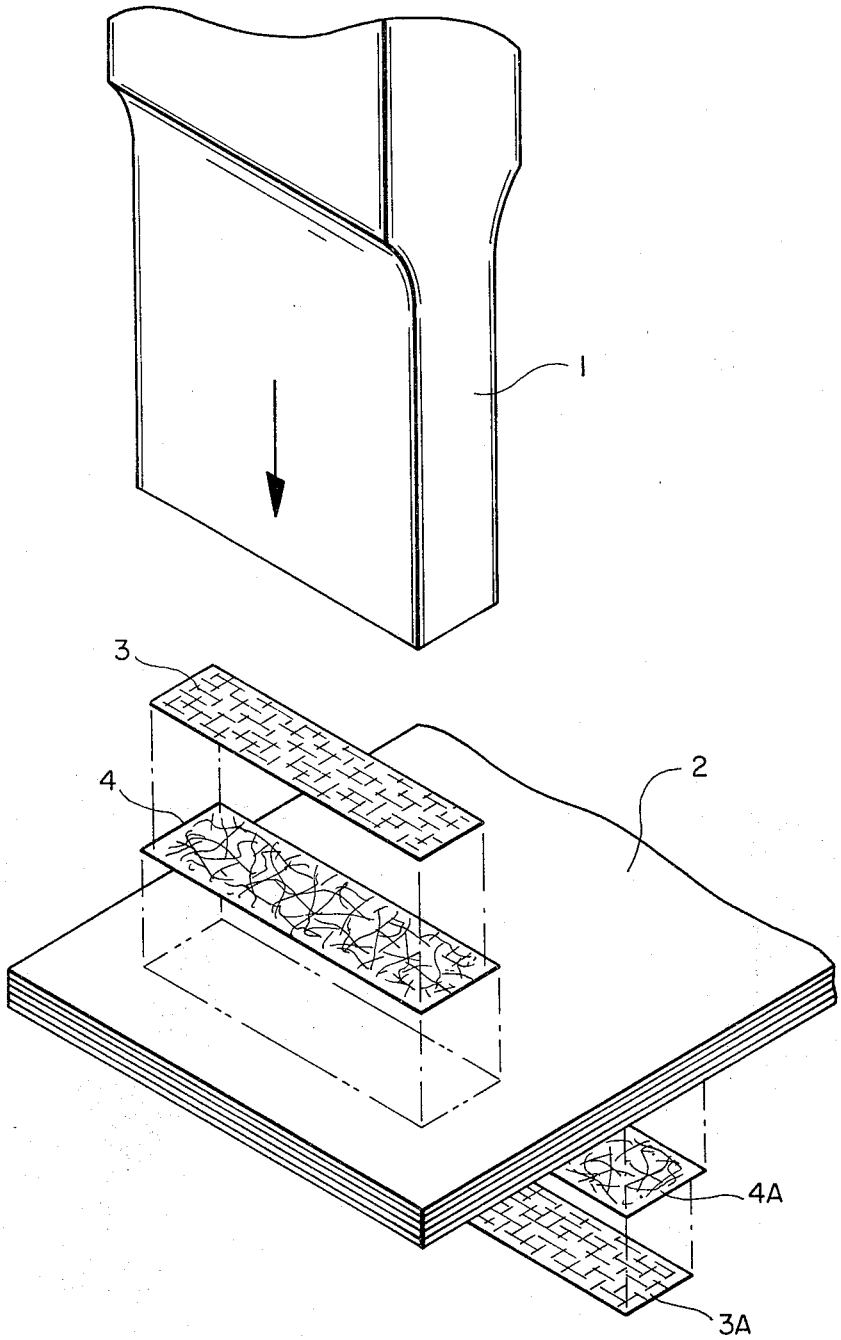
FIG. 1 is an exploded view illustrating the process of the invention.

One of the most important features of the present invention is the use of the compressible filamentous member. Preferably the filamentous member is resiliently compressible, in which case the bonding material serves not only to bond the various parts together but also to prevent elastic recovery of the filamentous member. I have found that the use of the filamentous member greatly reduces the likelihood of damaging the electrode and/or the conductive polymer element when the conductive member is secured to the electrode by heat and pressure. In the absence of the filamentous member and when using delicate electrodes, it is difficult to avoid fracturing the electrode which results in damaging sparking during use of the device. I have also found that the use of the filamentous member makes the process much more tolerant of changes in the process conditions.

The filamentous web comprises a plurality of conductive filaments, the term filament being used in a broad sense to include both continuous filaments and shorter lengths of filament which are commonly referred to as fibers, having for example a length of 0.2 to 4 inch, preferably 0.2 to 2 inch, and filaments of round and other cross-sections. The filaments can be composed of a conductive material e.g. of resistivity less than 1 ohm·cm., such as graphite or metal, or of an insulating material, e.g. glass, having a coating of a conductive material, e.g. a metal such as aluminum, on at least a part of the surface thereof. Because the filaments should deform to allow compression of the filamentous web and conformance with the electrode and/or the conductive member, they preferably have a minimum cross-sectional dimension of less than 0.005 inch, especially less than 0.003 inch, e.g. 0.0001 to 0.002 inch. The natural configuration of the filaments (i.e. the configuration of a single filament if removed from the filamentous member) is preferably substantially straight.

The filamentous member is preferably a non-woven web consisting essentially of conductive fibers. Such a web can be formed in situ by sprinkling loose fibers, but it is much more convenient to use a preformed self-supporting web. Woven fabrics of conductive filaments can also be used. The thickness of the filamentous member (before compression) is generally 0.005 to 0.1 inch, preferably 0.01 to 0.05 inch.

The conductive member is preferably composed of a material having a resistivity of less than $10^{-4}$ ohm·cm, particularly a metal. It preferably has apertures therein, but this in not essential in all cases. The member is preferably a wire screen, particularly one having a sieve size of 4 to 60 mesh, especially 8 to 35 mesh. However, other apertured members can be used, for example punched metal sheets, serpentine metal wires, wires welded together etc. The conductive member is laminar and usually of the same general shape as the surface of the electrode to which it is to be attached, which will usually be planar. The member can be bent to the desired shape during the bonding operation.

The bonding material must bond the electrode, the conductive member and the conductive filaments in the finished connection means. The chemical constitution of the bonding material can change during the bonding operation, but excellent results have been obtained using polymers which flow during bonding, without chemical change, and then solidify on cooling, including thermoplastic polymers which have not been cross-linked and thermoplastic polymers which have been cross-linked only to a level which still permits them to flow during the process. The bonding material can be an electrical insulator or an electrical conductor. The bonding material can be provided in any suitable place in the assembly, but is preferably between the conductive member and the electrode so that it does not have to flow through the conductive member to reach its final location. Particularly good results have been obtained when the bonding material is in the form of a layer adjacent the electrode, for example an electrically insulating polymeric layer.

The laminar electrodes to which the connecting means are secured can be of any type, including those disclosed in the prior art and prior applications referred to above. The term "laminar electrode" is used herein to include a plurality of wires (or like columnar electrodes) which lie in the same plane and which are to be connected together by the conductive member. The invention is particularly useful when the connection means is secured to a small portion of the electrode which is backed by the conductive polymer element or another polymer member. However, especially on small devices, the connection means can cover a large proportion (or even all) of the electrode surface. The devices of the invention generally comprise two laminar electrodes (i.e. the total number of electrodes is at least two but can be more), each of the electrodes having an electrical connecting means secured thereto in accordance with the invention, and the electrodes being connectable to a source of electrical supply through the electrical connection means and, when so connected, causing current to flow through the conductive polymer element.

The conductive polymer elements can be of any type, including those disclosed in the prior art and prior applications referred to above. Thus they can include one or more CW elements (i.e. elements composed of a ZTC conductive polymer) and/or one or more PTC elements and/or one or more NTC elements. The conductive polymer element will generally be laminar. The electrodes attached to a laminar conductive polymer element can be attached to opposite faces of the element, with the electrodes directly facing each other or staggered from each other, or they can be attached to the same face of the element. The conductive polymer element can be one which is heat-recoverable, preferably heat-shrinkable, e.g. a longitudinally heat-shrinkable elongate strip, and which can be caused to recover by passing current through the device.

The conductive member can be, or have secured thereto by soldering or welding or otherwise, the lead which is used to connect the electrode to a power supply. In another embodiment, the conductive member provides a conductive surface on the device to which contact is made by a metal plate which is pressed against it, e.g. by means of an electrical plug comprising an insulating housing and a metal plate which is maintained in pressure contact with the conductive member. Especially in this embodiment the surface of the conductive member remote from the conductive polymer element should be free from bonding material, and preferably the conductive fibers protrude from the bonding material in the apertures of the conductive member, especially so that they protrude beyond the plane containing the surface of the conductive member remote from the conductive polymer element, so that when the metal plate is pressed against the connecting means, the protruding fibers are deformed and pressed against the plate.

Figure 2:
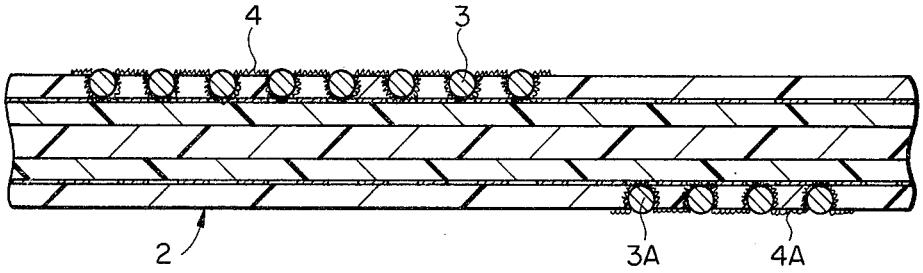
FIG. 2 is an cross-section of a part of a device of the invention.
Figure 3:
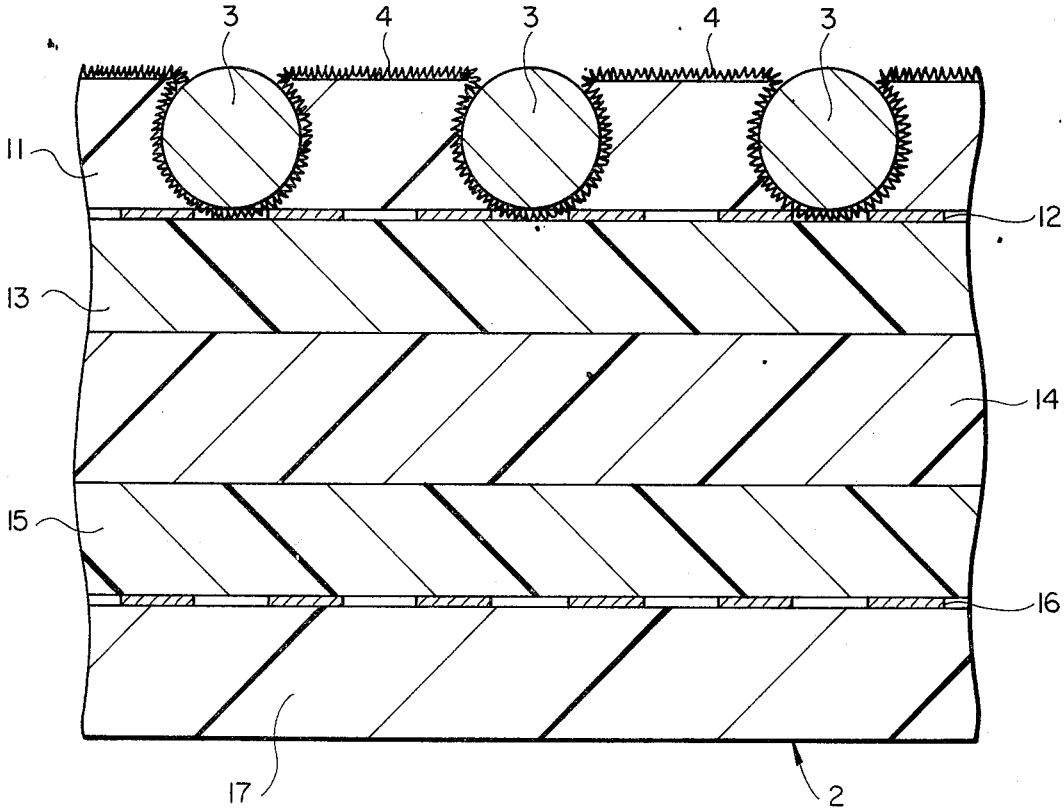
FIG. 3 is an enlarged view of part of FIG. 2.

Referring now to the drawings, FIG. 1 is an exploded view of the process of the invention as described in detail in the Example below, showing ultrasonic horn 1; heater blank 2 comprising a conductive polymer element sandwiched between two electrodes, and an insulating jacket; conductive members 3 and 3A; and filamentous members 4 and 4A. FIG. 2 is a cross-section of part of the product obtained in the Example and FIG. 3 is a detailed cross-section of part of FIG. 2. FIGS. 2 and 3 show the conductive members 3 and 3A and the deformed filamentous members 4 and 4A, and FIG. 3 also shows layers 11 to 17 of the heater blank corresponding to layers A to G respectively in the Example.

The invention is illustrated by the following Example, in which percentages are by weight.

EXAMPLE

A continuous 7-layer laminate about 7 inches wide and consisting of the following layers was prepared using conventional continuous hot lamination techniques.

Layer A (corresponding to Layer 11 in FIG. 3)—An electrically insulating layer, about 0.028 inch thick consisting essentially of about 82% of an ethylene/ethyl acrylate copolymer (sold by Union Carbide as DPD 6181), about 15% talc (sold by Cyprus Minerals as Mistron Vapor), about 2% carbon black as a pigment and U-V absorber, and about 1% antioxidant.

Layer B (corresponding to Layer 12 in FIG. 3)—An aluminum mesh, about 0.005 inch thick, (sold by Exmet as 5 A1-15-437R).

Layer C (corresponding to Layer 13 in FIG. 3)—A conductive polymer layer exhibiting CW behavior, having a thickness of about 0.020 inch, and consisting essentially of a mixture of about 82% of an ethylene/ethyl acrylate copolymer (sold by Union Carbide as DPD 6169), about 17% of carbon black and about 1% of antioxidant.

Layer D (corresponding to Layer 14 in FIG. 3)—A conductive polymer layer exhibiting PTC behavior, having a thickness of about 0.028 inch, and consisting essentially of a mixture of about 60% of high density polyethylene (sold by Phillips Petroleum as Marlex 6003), about 5% of an EPDM rubber, about 1% of antioxidant and about 34% of carbon black.

Layer E (corresponding to Layer 15 in FIG. 3). Same as Layer C.

Layer F (corresponding to Layer 16 in FIG. 3). Same as Layer B.

Layer G (corresponding to Layer 17 in FIG. 3). Same as Layer A.

The laminate was irradiated to a dosage of about 8 Mrad to cross-link the polymeric layers. It was then heated to a temperature between 100° and 150° C., stretched about 2× in the longitudinal direction while hot, and cooled in the stretched condition. A heater blank about 3.75 inch wide and about 36 inch long was cut from the cross-linked and stretched product.

The heater blank was provided with exposed electrical connection pads as described below and as illustrated in FIG. 1.

In order to make a connection pad connected to aluminum Layer 2 at one end of the heater, a strip about 2.5 by 0.5 inch was cut from a non-woven mat of randomly distributed aluminum-coated glass fibers, manufactured by International Paper from "Metafil" fibers made by Hexcel Corp. The mat had a weight of about 1.5 oz/yd$^2$ and contained about 40% aluminum, and the fibers were about 0.5 to 2 inch long. A strip about 2.25 by 0.375 inch was cut from a 12 mesh screen of 0.023 inch diameter aluminum wire.

The glass fiber strip was placed crossways on the heater blank about 0.375 inch from one end and equidistant from the edges. The aluminum strip was placed centrally on top of the glass fiber strip. An ultrasonic welding machine was used to press the aluminum strip and the glass fiber strip through the insulating Layer (1) to contact the aluminum Layer (2). The insulating Layer 1 was locally melted during the welding process and some of it flowed out of the weld area. The ultrasonic welding machine used was a Branson Sonic Welder, 400 series, with a 1 to 1.5 amplitude increasing booster horn. The contacting surface of the horn was 0.75×2.25 inch and completely covered the aluminum mesh strip. The weld time was 1.5 sec., the hold time was 1.5 sec. and the pressure was 60 psi.

Another exposed electrical connection pad was connected to aluminum Layer 6, through the insulating Layer 7, in the same way except that the glass fiber strip was located 1 inch from the end of the heater blank.

A connector was fitted over the end of the heater, so that foam-backed aluminum plates connected to the pins of the connector were pressed into contact with the exposed connection pads.

When the pins were connected to a 16 volt AC power supply, current flowed between the aluminum layers 2 and 6 through the conductive polymer layers 3, 4 and 5, causing the laminate to heat. After 2 to 4 minutes the laminate had heated to its recovery temperature and shrank to a length of about 20 to 25 inches.

Substantially the same results were obtained when the glass fiber mat was replaced by (a) a graphite fiber mat sold by Union Carbide as Thornel VMF-75, which is about 0.060 inch thick, or (b) by $\frac{3}{8}$ inch long loose aluminum-coated glass fibers (manufactured by Hexcel and sold under the trade name Metafil G-$\frac{3}{8}$) randomly sprinkled between the aluminum mesh strip and the insulating layer.

I claim:

1. An electrical device which comprises a conductive polymer element and a laminar electrode in physical contact with the conductive polymer element, said electrode having secured thereto an electrical connection means comprising (1) a laminar, self-supporting conductive member having apertures therein;

(2) a filamentous member which comprises a plurality of conductive filaments, at least some of the conductive filaments physically contacting the electrode and being deformed from their natural configuration to conform at least partially with the surface of the electrode, at least some of the conductive filaments physically contacting the laminar conductive member and being deformed from their natural configuration to conform at least partially with the surface of the laminar conductive member, and at least some of the conductive filaments lying between and electrically connecting the electrode and the laminar conductive member; and (3) a bonding material which bonds to each other the electrode, the laminar conductive member and at least some of the conductive filaments.

2. A device according to claim 1 which comprises two laminar electrodes, each electrode having a said electrical connecting means secured thereto.

3. A device according to claim 1 wherein said filamentous member is a non-woven web of conductive fibers.

4. A device according to claim 3 wherein said conductive fibers are selected from the group consisting of glass fibers having a metal coating on at least a part of the surface thereof, graphite fibers and metal fibers.

5. A device according to claim 1 wherein the conductive polymer element is in physical contact with the face of the electrode opposite the face of the electrode to which said connecting means is attached.

6. A device according to claim 1 wherein the surface of the conductive member remote from the conductive polymer element is free of the bonding material.

7. A device according to claim 6 wherein some of the conductive fibers protrude from the bonding material in the apertures of the conductive member.

8. A device according to claim 7 wherein some of the conductive fibers protrude beyond the plane containing the surface of the conductive member remote from the conductive polymer element.

9. A device according to claim 3 wherein the natural configuration of the fibers is substantially straight.

10. A device according to claim 1 wherein the filaments have a mininum cross-sectional dimension of less than 0.005 inch.

11. A device according to claim 10 wherein the filaments have a minimum cross-sectional dimension of 0.0001 to 0.002 inch.

12. A device according to claim 1 wherein the conductive member is composed of a metal.

13. A device according to claim 12 wherein the conductive member comprises at least one wire.

14. A device according to claim 13 wherein the conductive member is a wire screen.

15. A device according to claim 14 wherein the screen has a sieve size of 4 to 60 mesh.

16. A device according to claim 15 wherein the screen has a sieve size of 8 to 35 mesh.

17. A device according to claim 12 wherein the conductive member is a punched metal sheet.

18. A device according to claim 1 wherein the bonding material comprises a thermoplastic polymer.

19. A device according to claim 1 wherein the bonding material comprises a cross-linked thermoplastic polymer.

20. A device according to claim 1 wherein the bonding material is an electrical insulator.

21. A device according to claim 2 which is heat recoverable and which can be caused to recover by passing electrical current through the device.

22. A heat-recoverable electrical device which comprises a heat-recoverable laminar conductive polymer element and two laminar electrodes, each of said electrodes comprising a portion to which is secured an electrical connection means comprising (1) a laminar, self-supporting conductive member composed of a metal and having apertures therein;

(2) a filamentous member which comprises a plurality of conductive filaments, at least some of the conductive filaments physically contacting the electrode and being deformed from their natural configuration to conform at least partially with the surface of the electrode, at least some of the conductive filaments physically contacting the laminar conductive member and being deformed from their natural configuration to conform at least partially with the surface of the laminar conductive member, and at least some of the conductive filaments lying between and electrically connecting the electrode and the laminar conductive member; and (3) a bonding material which bonds to each other the electrode, the laminar conductive member and at least some of the conductive filaments.

23. A device according to claim 22 wherein the filamentous member is a non-woven web of conductive fibers whose natural configuration is substantially straight and which have a minimum cross-sectional dimension of less than 0.005 inch.

24. A device according to claim 23 wherein the fibers are selected from the group consisting of glass fibers having a metal coating on at least a part of the surface thereof, graphite fibers and metal fibers.

25. A device according to claim 23 wherein the outer surface of the conductive member remote from the conductive polymer is free of bonding material and some of the conductive fibers protrude from the bonding material in the apertures of the conductive member.

26. A device according to claim 25 which is in the form of a longitudinally heat-shrinkable elongate strip with a said electrical connection means secured to each of the electrodes, and which further comprises an electrical plug comprising an insulating housing and a metal plate which is maintained in pressure contact with one of said electrical connection means, the protruding fibers physically contacting the metal plate and being deformed from their natural configuration to conform at least partially with the metal plate.

27. A device according to claim 21 which comprises a jacket composed of an insulating polymer which insulates the device except in the area of said electrical connection means and wherein said bonding material is also composed of said insulating polymer.

* * * * *